United States Patent [19]

Duran et al.

[11] Patent Number: 4,828,052

[45] Date of Patent: May 9, 1989

[54] ULTRASONIC DRILLING APPARATUS

[75] Inventors: Edward L. Duran, Santa Fe; Ralph L. Lundin, Los Alamos, both of N. Mex.

[73] Assignee: The United States of America as represented by the United States Department of Energy, Washington, D.C.

[21] Appl. No.: 208,540

[22] Filed: Jun. 20, 1988

[51] Int. Cl.[4] ..... E21B 7/24

[52] U.S. Cl. ..... 175/55; 175/56; 51/59 SS

[58] Field of Search ..... 175/55, 56; 51/59 SS; 299/14

[56] References Cited

U.S. PATENT DOCUMENTS

| | | | |
|---|---|---|---|
| 3,091,060 | 5/1963 | Giegerich et al. | 51/59 |
| 3,415,330 | 12/1968 | Bouyoucous | 175/56 |
| 3,596,501 | 7/1971 | Bodine | 37/1 |
| 3,614,484 | 10/1971 | Shoh | 310/8.2 |
| 3,837,121 | 9/1974 | Schirmer | 51/56 |
| 4,366,988 | 1/1983 | Bodine | 299/14 |
| 4,598,281 | 10/1985 | Bodine | 175/56 X |

*Primary Examiner*—William P. Neuder

*Attorney, Agent, or Firm*—Milton D. Wyrick; Paul D. Gaetjens; William R. Moser

[57] ABSTRACT

Apparatus attachable to an ultrasonic drilling machine for drilling deep holes in very hard materials, such as boron carbide, is provided. The apparatus utilizes a hollow spindle attached to the output horn of the ultrasonic drilling machine. The spindle has a hollow drill bit attached at the opposite end. A housing surrounds the spindle, forming a cavity for holding slurry. In operation, slurry is provided into the housing, and into the spindle through inlets while the spindle is rotating and ultrasonically reciprocating. Slurry flows through the spindle and through the hollow drill bit to cleanse the cutting edge of the bit during a drilling operation.

8 Claims, 2 Drawing Sheets

ULTRASONIC DRILLING APPARATUS

BACKGROUND OF THE INVENTION

This invention relates to the field of ultrasonic drilling, and, more specifically, to ultrasonic drilling apparatus providing a continuous slurry feed through a hollow drill bit to flush the bit throughout a drilling operation. The invention is a result of a Contract with the Department of Energy (Contract No. W-7405-ENG-36).

Ultrasonic drilling is a highly developed art used to machine or drill difficult materials such as ceramics, glasses, and refractories, as well as very hard materials such as high purity (purity higher than 98%) boron carbide, kyon, silicon carbide, tantalum carbide and the like. In ultrasonic drilling, the drill bit reciprocates at an ultrasonic frequency of approximately 20 kilohertz and an amplitude of approximately 0.0008 in., and, if not an impact machine, also rotates. In some applications, a drilling slurry containing abrasive particles is flowed about the drill bit during the drilling process.

For the drilling of very hard materials, tubular drill bits with diamond cutting edges and an abrasive slurry are used. However, it has been heretofore impractical to drill a hole deeper than about three-eighths of an inch in materials whose hardness approaches that of diamond. This is particularly true with high purity boron carbide, which is about 14.7 on the revised Moh scale. Deeper drilling is prevented by the action of the abrasive particles and workpiece cuttings adhering to or wiping the diamond edge of the bit, rendering it ineffective.

As stated, a diamond edged ultrasonic bit with an abrasive slurry can drill into a material such as high purity boron carbide a distance of only approximately three-eighths of an inch. Beyond this distance, conventional methods of supplying slurry to the bit are not effective in keeping the bit clean. To drill deeper holes, it is necessary to maintain a flow of slurry across the edge of the drill bit, while still providing effective ultrasonic reciprocation.

One attempt at solving this problem in an impact only machine is disclosed in U.S. Pat. No. 3,091,060 to Giegerich et al. In one embodiment slurry is introduced around the bit and withdrawn through a passage in the machine member. Another embodiment has the slurry being introduced around the bit and withdrawn through a pilot hole in the material being drilled. However, it is very doubtful that simply pouring slurry at the surface of the workpiece would be effective to deliver slurry to the tip of the bit when the tip has drilled beyond a short distance from the surface of the workpiece. While the method disclosed in this patent may be effective for impact machines drilling shallow holes, it teaches nothing about obtaining a flow of slurry in a rotating ultrasonic drill. Impact machines, even with slurry flow, cannot satisfactorily drill high purity boron carbide.

It is therefore an object of the present invention to provide an apparatus for rapidly drilling deep holes in hard materials such as boron carbide.

It is another oject of the present invention to rapidly drill holes in very hard materials without undue mechanical or thermal stresses to the material.

It is another object of the present invention to provide apparatus for drilling deep holes in hard materials which may be easily mounted on existing ultrasonic drills.

An advantage of the present invention is that apparatus in accordance with the invention requires little downtime for bit cleaning and other maintenance.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, ultrasonic apparatus for drilling deep holes in very hard materials for use with an ultrasonic drilling machine having an ultrasonic output horn may comprise a spindle attachable to the ultrasonic output horn and effective to transmit ultrasonic motion from the ultrasonic output horn, where the spindle further defines a first cavity for receiving, containing and passing slurry therethrough. A housing, which is attachable to the output horn, surrounds the spindle, sealingly supporting the spindle and providing communication with a source of slurry. The housing and the spindle form a second cavity for the slurry which surrounds the spindle, and the second cavity communicates with the first cavity. The spindle contains means for operably attaching a hollow drill bit, the bit communicating with the first cavity in the spindle.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Figure 1:
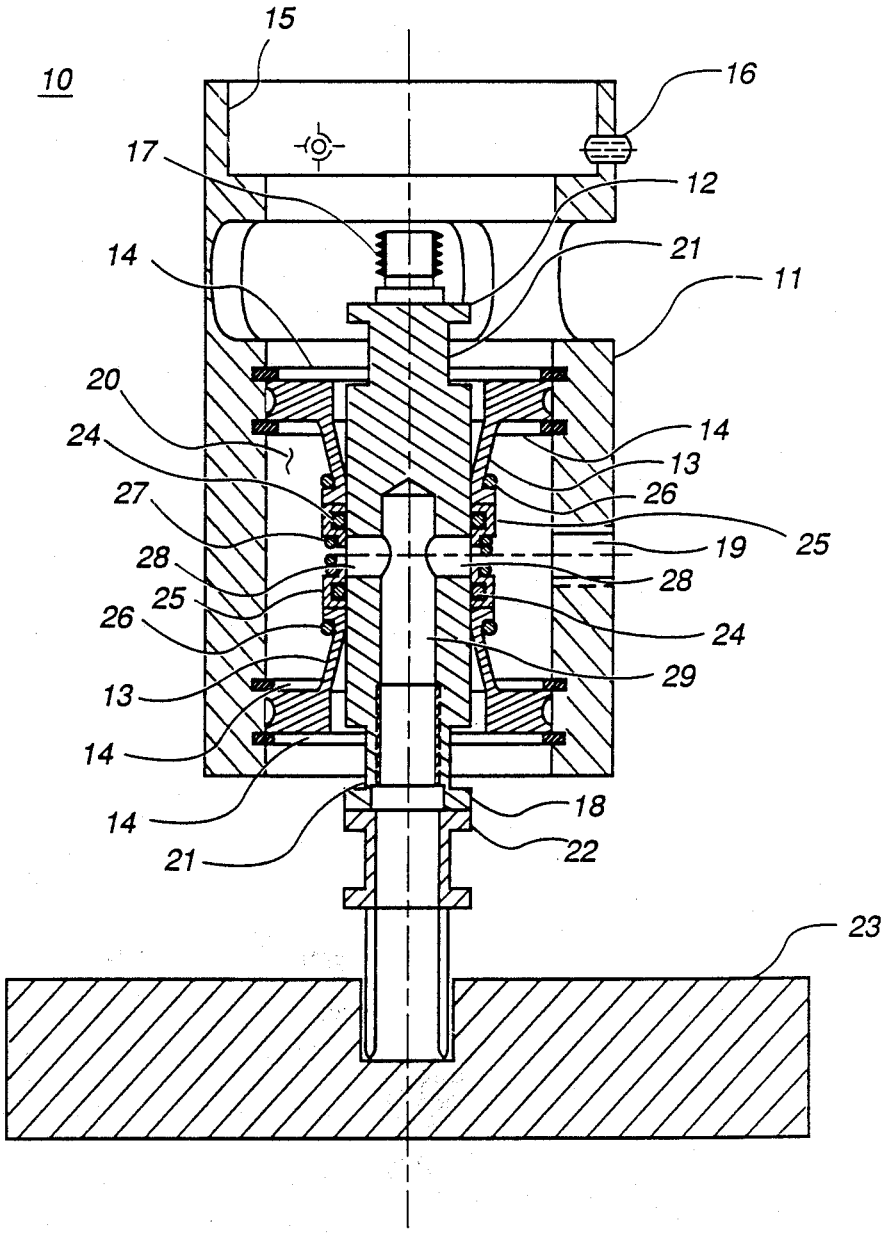
FIG. 1 is a cross-sectional view of an embodiment of the present invention.

Reference is now made to FIG. 1 wherein there is shown a cross-sectional view of one embodiment of the invention in which ultrasonic drilling apparatus according to the present invention, generally denoted as 10, is drilling into material 23, which may be boron carbide. As seen, outer body 11 houses spindle 12 rotatably retained in place by ring seals 13 and seal retainers 14, which may be conventional snap rings. Apparatus 10 attaches to an ultrasonic machine (not shown) by sliding mounting recess 15 onto the machine's housing and tightening set screws 16. Machine spindle connection 17 can then be screwed onto the machine's output horn (not shown) using wrench flats 21. A conventional tubular drill bit 22, usually with a diamond cutting edge, attaches to spindle 12 at bit connection 18 for ultrasonically drilling material 23.

Outer body 11, which in one embodiment is made of 6061-T6 aluminum, comprises at least one slurry inlet port 19 for the introduction of slurry into slurry chamber 20, which surrounds spindle 12. Slurry chamber 20 is a cavity defined by the inner surface of outer body 11 and by ring seals 13, which are held in place by seal retainers 14, and held sufficiently tightly against hollow spindle 12 by outer spring 20 to prevent leakage of slurry.

Seal retainers 14 are conventional snap rings having an outer diameter slightly larger than the inner diameter of outer body 11. This allows seal retainers 14 to be snapped into grooves in the inner surface of outer body 11, to retain ring seals 13 (FIG. 1).

O rings 24, which may comprise neoprene rubber, are encased within O ring housings 25, which may comprise 304 stainless steel. Together, O rings 24 and O ring housings 25 prevent abrasive slurry in slurry chamber 20 from contacting the outer surface of spindle 12, in order to prevent abrasion of spindle 12.

It has been found that an effective slurry can be made from 240 or 320 boron carbide grit, using the ratio of one-half pound grit to one gallon of coolant, such as an 80:1 solution of water and a water soluble machining coolant.

Intermediate spring 27 maintains separation between ring seals 13 to allow slurry to be forced through spindle slurry inlets 28 and into spindle slurry outlet 29, the central cavity in spindle 12, and out through drill bit 22. Intermediate spring 27 also maintains the seal between ring seals 13 and O ring housings 25.

Ring seals 13 and O rings 24 must contact spindle 12 substantially at the positions shown in FIG. 1. This is because contact with spindle 12 must be near a null point of the ultrasonic motion in spindle 12 so that ultrasonic motion through spindle 12 will not be damped. In this embodiment, a null point is located at the centerline of spindle slurry inlets 28.

Figure 2:
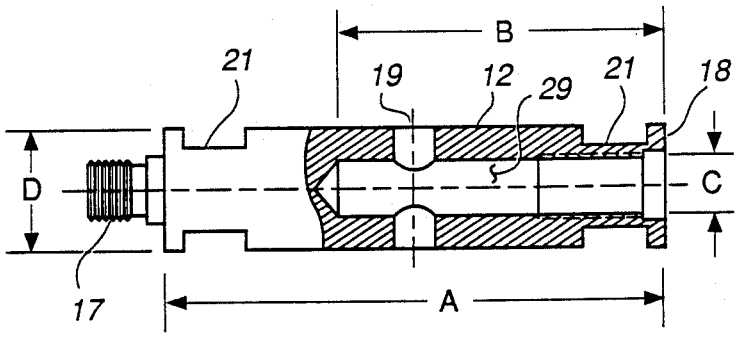
FIG. 2 is a partial cross section of a hollow spindle according to the present invention.

Referring now to FIG. 2, there is shown a partial cross section of spindle 12, which, in one embodiment, may be constructed of 304 stainless steel. It is critical that spindle 12 be properly dimensioned in order that it effectively transmits ultrasonic waves from an ultrasonic machine to the cutting edge of bit 22 (FIG. 1). These dimensions will depend upon the specifications included with the ultrasonic machine and upon the particular material selected for spindle 12. Both the density and the elasticity of a material will affect the passage of ultrasonic waves through spindle 12.

FIG. 2 illustrates the dimensions of an embodiment comprising stainless steel for use on a machine operating at approximately 20 kHz, and having a first tuned length of 6 in. This first tuned length is only a guide, and certain dimensional adjustments will be necessary depending on the configuration of spindle 12 and the composition of the slurry used. In this embodiment, the longitudinal dimension denoted as "A" in FIG. 2, is 3.062 in. (making the overall first tuned length with bit 22 attached 6.062 in., instead of the specified 6 in.); the diameter, denoted as "D," is 0.750 in.; the length of spindle slurry outlet 29, denoted as "B," is 2.00 in.; and the diameter of spindle slurry outlet 29, denoted as "C," is 0.332 in. It is important to note that the centerline of spindle slurry inlets 19 is at the mid-point of longitudinal dimension "A," as that is the approximate null point of the ultrasonic waves in spindle 12 for this embodiment.

As previously discussed, spindle 12 must be properly dimensioned for the ultrasonic machine with which it is to be used so that it will effectively pass ultrasonic waves or reciprocations to the cutting edge of bit 22. These dimensions are determined through knowledge of the ultrasonic machine, and on the composition of spindle 12. Additionally, ring seals 13 and O rings 24 (FIG. 1) must contact spindle 12 near the null point of the ultrasonic waves in spindle 12, so that ultrasonic motion through spindle 12 is not damped.

As shown in FIG. 1, bit 22 is attached to spindle 12 by way of female threaded bit connection 18. Also, spindle 12 is attached to an ultrasonic machine (not shown) through male threaded machine spindle connection 17 in the same manner as drill bit 22 would attach if apparatus 10 were not in use.

In operation, while spindle 12 is both rotating and being stretched and retracted by an ultrasonic drilling machine (not shown), slurry in slurry chamber 20 (FIG. 1) is provided to spindle slurry inlets 28 through intermediate spring 27 (FIG. 1), and into spindle slurry outlet 29. For normal applications, two spindle slurry inlets 28 are sufficient. From spindle slurry outlet 29, the slurry passes out through drill bit 22 to continuously cleanse the cutting edge of bit 22 (FIG. 1).

Figure 3:
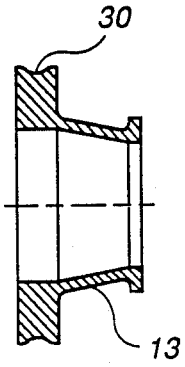
FIG. 3 is a cross-sectional view of a ring seal according to the present invention.

Referring now to FIG. 3, there is shown a cross-sectional view of ring seal 13. In one embodiment ring seals 13 are comprised of Teflon ®. However, other materials could be employed if they are sufficiently pliable to provide the required sealing, and are impervious to the slurry. It has been found that, due to the excellent sealing of O rings 24 and ring seals 13, comprising Teflon ®, ring seals 13 have a lifetime of approximately 50 hours, and can be replaced in about 30 minutes after removing outer seal retainers 14. Annular channel 30 serves to further prevent the escape of slurry between ring seals 13 and the interior surface of outer body 11.

Operation of apparatus 10 is best understood by reference back to FIG. 1. Initially, apparatus 10 is connected to an ultrasonic drilling machine (not shown) through set screws 16 tightening mounting recess 15 onto the housing of the machine. Next, machine spindle connection 17 is screwed into the machine's output horn using wrench flats 21. Lastly, bit 22, which may be a diamond edged tubular drill bit, is screwed into bit connection 18 of spindle 12 and tightened using wrench flats 21. Bit 22 is then brought near to material 23 and the ultrasonic drill is activated to provide both rotation and ultrasonically reciprocating vertical movement to bit 22 through spindle 12.

During operation of the ultrasonic drill, slurry is delivered under pressure to slurry entry port 19 by any convenient means, filling slurry chamber 20. From slurry chamber 20 the slurry passes into central cavity 29 of spindle 12 through intermediate spring 27 and spindle slurry inlets 28. The slurry then flows through spindle slurry outlet 29, and the central hollow portion of drill bit 22 to the cutting edge. In practice of the invention, slurry is continuously supplied to the cutting edge of drill bit 22, effectively cleaning the cutting edge, and insuring that residue from material 23 is continuously removed. This cleaning of the cutting edge of drill bit 22 results in greatly reduced drilling times. For example, a three-eighths-inch cavity can be drilled into high purity boron carbide in about 20 seconds. With prior art methods and apparatus, such a cavity would require approximately 8 hours of drilling.

Apparatus 10, according to the present invention, may be employed to drill very hard materials such as high purity boron carbide, silicone carbide, and aluminum oxide, as well as any refractory material. It is also extremely useful in the drilling of glass, as the flow of slurry controls heat build up, thereby lessening the chance of fracture.

The foregoing description of embodiments of the present invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An ultrasonic drilling apparatus for use with an ultrasonic drilling machine having an ultrasonic output horn, said apparatus comprising:

a spindle attachable to said ultrasonic output horn effective to transmit ultrasonic motion from said output horn and defining a first cavity for receiving, containing and passing a slurry therethrough;

housing means surrounding said spindle and attachable to said ultrasonic drilling machine for sealingly supporting said spindle and receiving said slurry, said housing means and said spindle forming a second cavity for said slurry surrounding said spindle;

means connecting said first and second cavities for passing said slurry; and means for operably attaching a hollow drill bit to said spindle, said hollow drill bit communicating with said first cavity in said spindle for passing said slurry to a cutting edge of said drill bit.

2. The apparatus as described in claim 1, wherein said spindle is cylindrical, and rotatable and reciprocable in said housing means.

3. The apparatus as described in claim 2, wherein said housing is substantially cylindrical and comprises spaced apart first and second seal means disposed along said spindle for sealing said second cavity and allowing said spindle to rotate and reciprocate within said housing means.

4. The apparatus as described in claim 3, wherein said first and second seal means are maintained in sealing contact with said spindle by springs located at positions along said spindle where ultrasonic motion is not damped.

5. The apparatus as described in claim 1, wherein said first cavity communicates with said second cavity through one or more first ports in said spindle.

6. The apparatus as described in claim 1, wherein said second cavity communicates with a source of slurry through one or more second ports in said housing means.

7. The apparatus as described in claim 3, further comprising a plurality of O rings for substantially preventing abrasive contact between said slurry and said spindle disposed about said spindle intermediate of said first seal means and said second seal means at positions effective to allow said spindle to rotate and reciprocate.

8. The apparatus according to claim 6, wherein said O rings are enclosed within annular channels encircling said spindle, said annular channels held by springs in positions along said spindle where ultrasonic motion is not damped.

* * * * *